US006053467A

United States Patent [19]

Walker et al.

[11] Patent Number: 6,053,467

[45] Date of Patent: Apr. 25, 2000

[54] PORTABLE EASEL

[76] Inventors: Hugh C. Walker, 120 Raven Ct.; Thomas J. Anderson, 1325 Greenbrook Dr., both of Danville, Calif. 94526

[21] Appl. No.: 09/123,864

[22] Filed: Jul. 28, 1998

[51] Int. Cl.[7] ..... A47B 97/04

[52] U.S. Cl. ..... 248/450; 40/764; 248/346.03

[58] Field of Search ..... 248/450, 441.1, 248/451, 454, 346.03, 346.01; 40/764, 761

[56] References Cited

U.S. PATENT DOCUMENTS

| | | | |
|---|---|---|---|
| Re. 17,951 | 2/1931 | Brecht | 40/764 |
| 4,263,732 | 4/1981 | Gutierrez et al. | 40/764 |
| 4,512,603 | 4/1985 | Williams | 248/451 X |
| 5,193,777 | 3/1993 | Faulstich | 248/441.1 |
| 5,893,546 | 4/1999 | Renfroe | 248/451 |

*Primary Examiner*—Ramon O. Ramirez
*Attorney, Agent, or Firm*—Thomas R. Lampe

[57] ABSTRACT

A portable easel includes an easel body with a slot formed therein for receiving the lower end of a member having a painting surface. A connector has a notch formed therein for receiving the top end of the member. An elastic element extends between the connector and the easel body to bias the member toward a tilted orientation.

21 Claims, 4 Drawing Sheets

PORTABLE EASEL

TECHNICAL FIELD

This invention relates to a portable easel for supporting a member having a flat painting surface. The portable easel can be utilized to support a member in the form of a canvas stretched over a frame or a canvas board, for example.

BACKGROUND OF THE INVENTION

Conventional easels are relatively bulky and difficult to transport. Typically, such easels are relatively expensive and complex.

DISCLOSURE OF INVENTION

The present invention relates to a portable easel which is relatively simple and inexpensive. The portable easel may be readily transported between locations. The portable easel is very compact and yet provides a highly stable platform for a member having a painting surface, such as a framed canvas, canvas board or the like. The device readily lends itself to use with members of different sizes and the member can readily be installed on or removed from the easel.

The portable easel is for supporting a member having a flat painting surface, elongated top and bottom ends and sides extending between the top and bottom ends.

The portable easel includes an easel body having an upper surface defining a slot for receiving the bottom end of the member.

A connector is provided for releasable connection to the top end of the member while the bottom end thereof is received in the slot.

A flexible element is connected to the connector and to the easel body for exerting a bias on the member urging the member toward a tilted orientation with the lower end of the member bearing against the easel body at the location of the slot to limit movement of the member and stabilize the member relative to the easel body. In the preferred embodiment disclosed herein, the flexible element is resilient and comprises an elongated elasticized cord.

Other features, advantages, and objects of the present invention will become apparent with reference to the following description and accompanying drawings.

MODE FOR CARRYING OUT THE INVENTION

Referring now to FIGS. 1–11 of the drawings, a portable easel constructed in accordance with the teachings of the present invention includes an easel body 10 formed of any suitable material such as wood, plastic or metal. An elongated slot 12 is formed in the easel body and extends the entire width of the easel body.

Slot 12 includes a first slot segment 14 extending downwardly a first predetermined distance into the easel body and a second slot segment 16 communicating with the first slot segment and extending downwardly a second predetermined distance into the easel body exceeding the first predetermined distance. The second slot segment is substantially narrower than the first slot segment, as shown.

Figure 6:
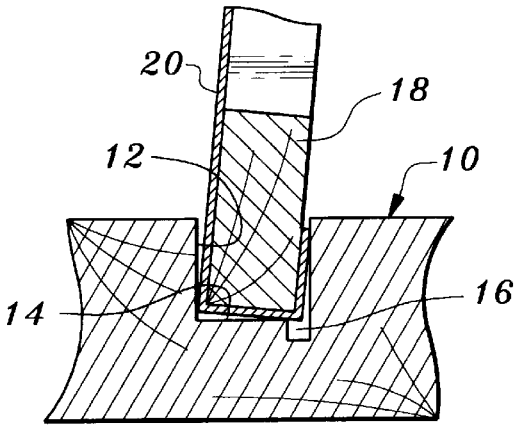
FIG. 6 is an enlarged cross-sectional view taken along the line 6—6 in FIG. 1 and illustrating a segment of the easel body and a portion of the frame and stretched canvas.

As perhaps may best be seen with reference to FIG. 6, the first slot segment 14 is somewhat wider than the thickness of a member including a frame 18 having canvas 20 stretched thereon.

Figure 8:
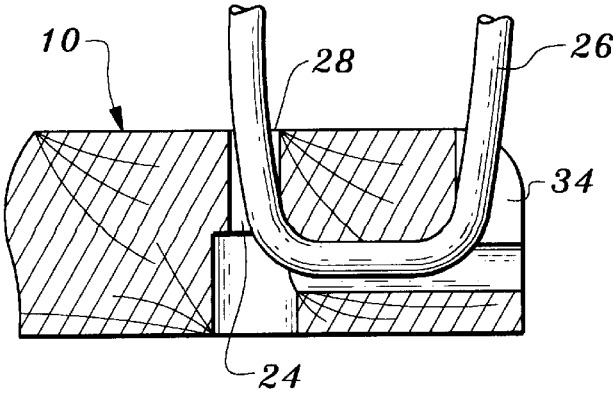
FIG. 8 is an enlarged cross-sectional view taken along the line 8—8 in FIG. 1 and illustrating details of the easel body and elasticized cord employed in the illustrated mode of the invention.

Referring now to FIG. 8, a passageway 24 is formed in easel body 10 having a vertical leg and a horizontal leg. The passageway 24 slidably accommodates therein a flexible cord which in this embodiment is a resilient element in the form of an elongated elasticized cord 26 of the type commonly referred to as a shock cord or bungee cord. Passageway 24 terminates at one end thereof at a hole 28 formed in the upper surface of the easel body and at the other end thereof at the rear of the easel body. The end of the cord 26 at the rear of the easel body is knotted as shown and the other end thereof is in the form of a hook attached to a connector 30, the latter being described in more detail below.

A recess 34 is formed in the easel body and communicates with passageway 24. The side walls defining the recess 34 are spaced apart a distance less than the diameter of elasticized cord 26 so that the cord may be selectively wedged into position in the recess to lock the cord into position relative to the easel body. That is, the cord may be suitably manipulated so that it is tightly frictionally engaged by the easel body at the location of the recess to releasably lock the elasticized cord in place relative to the easel body. The position on the cord where it is locked to the easel body can be readily changed by disengaging the cord from the easel body at the recess, sliding the cord in passageway 24 to the desired position, and reinserting the cord into the recess to provide locking frictional engagement.

Connector 30 may be formed of any suitable material and the connector defines a plurality of notches, 36, 38 and 40. Notches 36 and 40 are relatively narrow as compared to notch 38. Notch 38 has a width generally corresponding to the width of frame 18 having canvas 20 stretched thereover.

Figure 1:
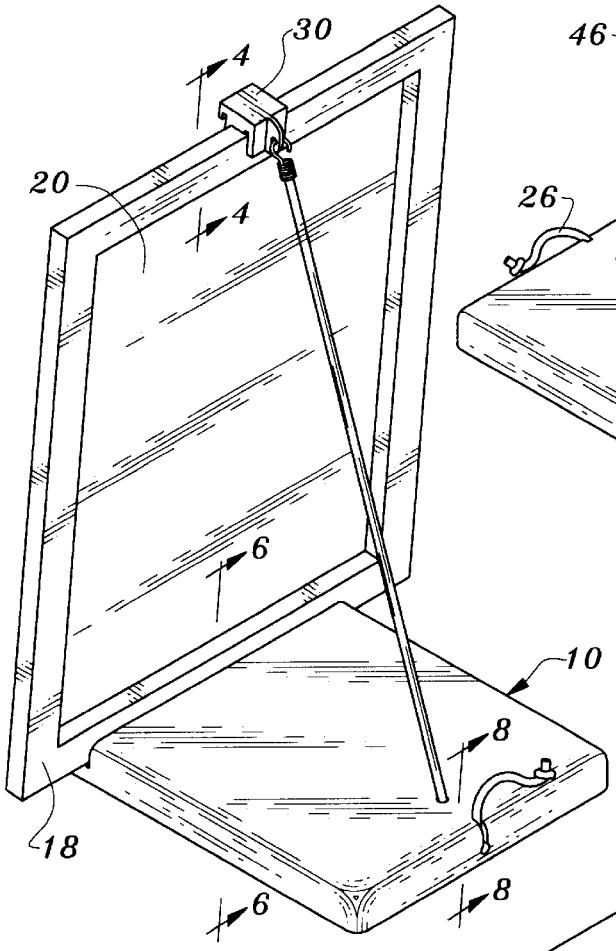
FIG. 1 is a rear, perspective view illustrating a preferred embodiment of a portable easel constructed in accordance with the teachings of the present invention supporting a member in the form of canvas stretched over a frame.
Figure 4:
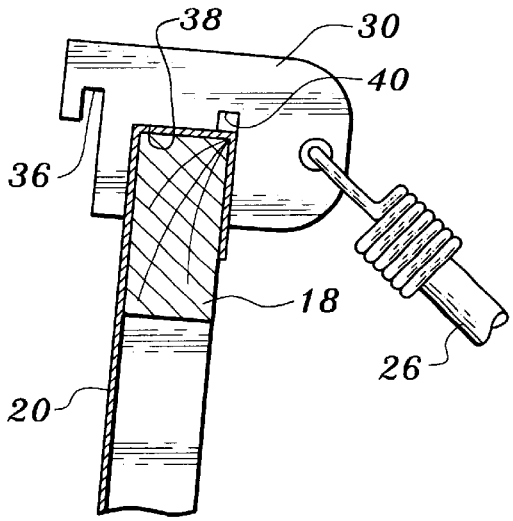
FIG. 4 is an enlarged, cross-sectional view of those portions of the portable easel and member in the form of canvas stretched on a frame taken along the line 4—4 in FIG. 1.
Figure 10:
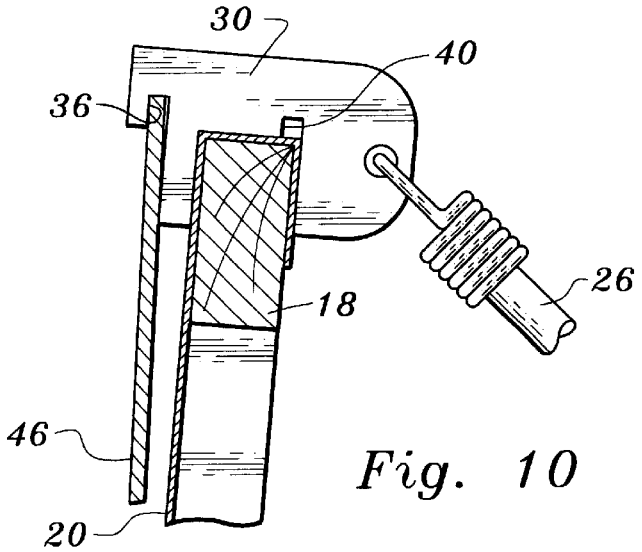
FIG. 10 is a view similar to FIG. 9, but illustrating the connector accommodating both a canvas board and a member comprising canvas and frame.

FIGS. 1, 4 and 10 show the connector at the top end of the frame and canvas member. The cord 26 is maintained under tension between connector 30 and the easel body so that the frame and canvas member will be urged rearwardly by the cord toward a tilted position or orientation. Preferably the actual tilt of the frame and canvas member is relatively slight; however, it is within the scope of this invention to cover an arrangement wherein the tilt of the member is considerable as well as the situation wherein the member does not tilt at all but is simply urged toward tilted position. The lower or bottom end of the frame and canvas member bears against the easel body at the location of elongated slot 12 to limit movement of the member and stabilize the member relative to the easel body. As indicated above, the degree of tension exerted by the cord can be readily modified by changing the location where the cord is locked to the easel body within recess 34.

Figure 2:
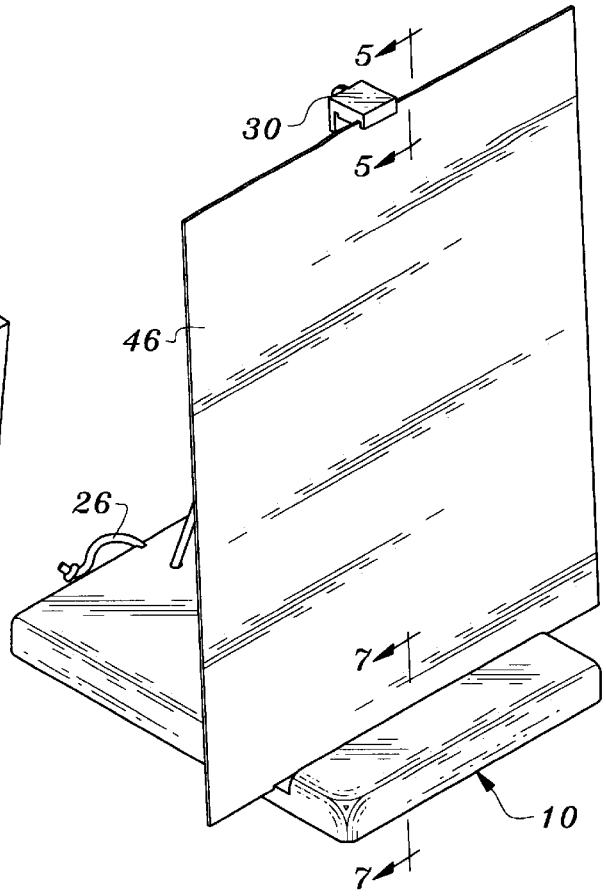
FIG. 2 is a frontal, perspective view of the portable easel supporting a member in the form of canvas board.
Figure 3:
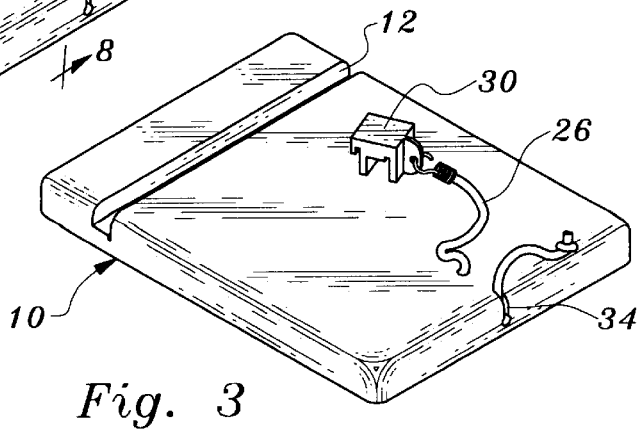
FIG. 3 is a frontal, perspective view illustrating the portable easel when not in use.
Figure 5:
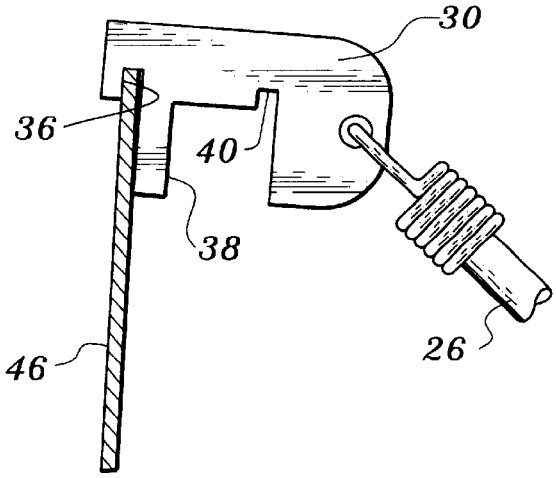
FIG. 5 is an enlarged cross-sectional view taken along the line 5—5 in FIG. 2 and illustrating the connector and related structure of the portable easel holding canvas board.
Figure 7:
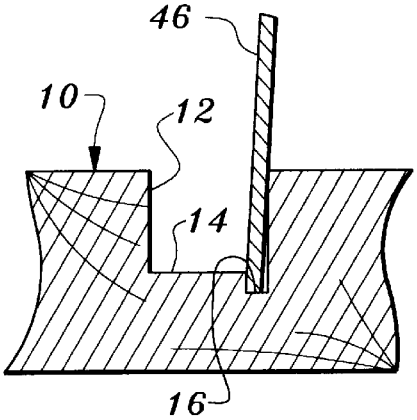
FIG. 7 is an enlarged cross-sectional view taken along the line 7—7 in FIG. 2 and illustrating a portion of the easel body and a portion of the canvas board supported thereby.
Figure 9:
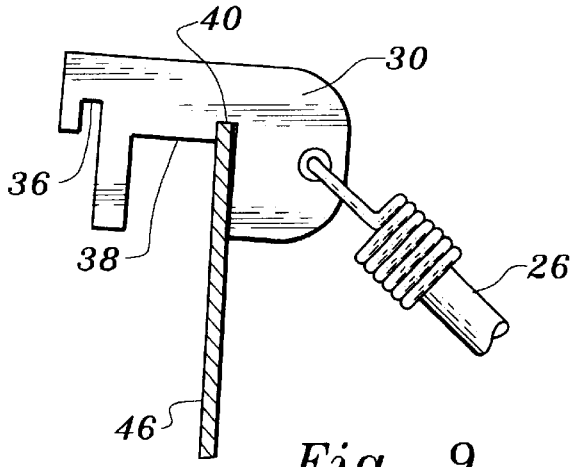
FIG. 9 is a view similar to FIG. 5, but illustrating canvas board located at an alternate location in the connector of the portable easel.
Figure 11:
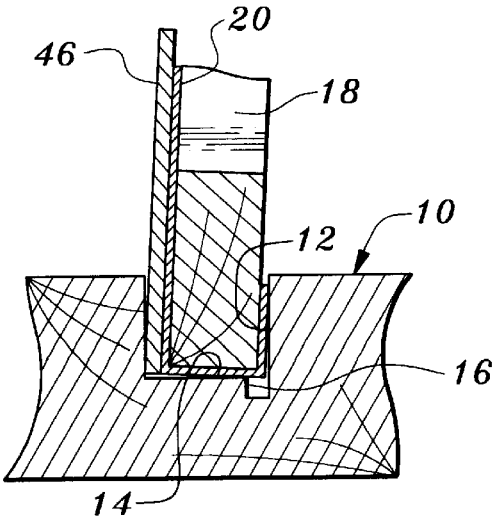
FIG. 11 is a view similar to FIG. 6, but illustrating both canvas board and a canvas on frame structure positioned in an elongated slot of the easel body.

The portable easel can be utilized to support a member having a flat painting surface other than the frame and canvas combination. FIGS. 2, 5, 7 and 9 through 11 illustrate the apparatus supporting and holding in place a canvas board 46. The top end of the canvas board may be inserted into notch 36 (as shown in FIGS. 2, 5 and 10, for example) or in notch 40 (as shown in FIG. 9). The bottom or lower end of the canvas board is normally positioned in second slot segment 16 as shown in FIG. 7. Alternatively, the canvas board may be inserted in the connector and in the elongated slot 12 of the easel body 10 along with a canvas and frame member. In this latter situation, the top end of the canvas board is disposed in notch 36 and the lower end of the canvas board joins the frame and canvas member in first slot segment 14, as shown in FIG. 11. It will be appreciated that the canvas board member is supported in some degree by the canvas and frame member when both members are in position. Of course, the canvas board may be positioned in notch 36 of the connector with the lower end thereof in second slot segment 16 if desired.

Figure 12:
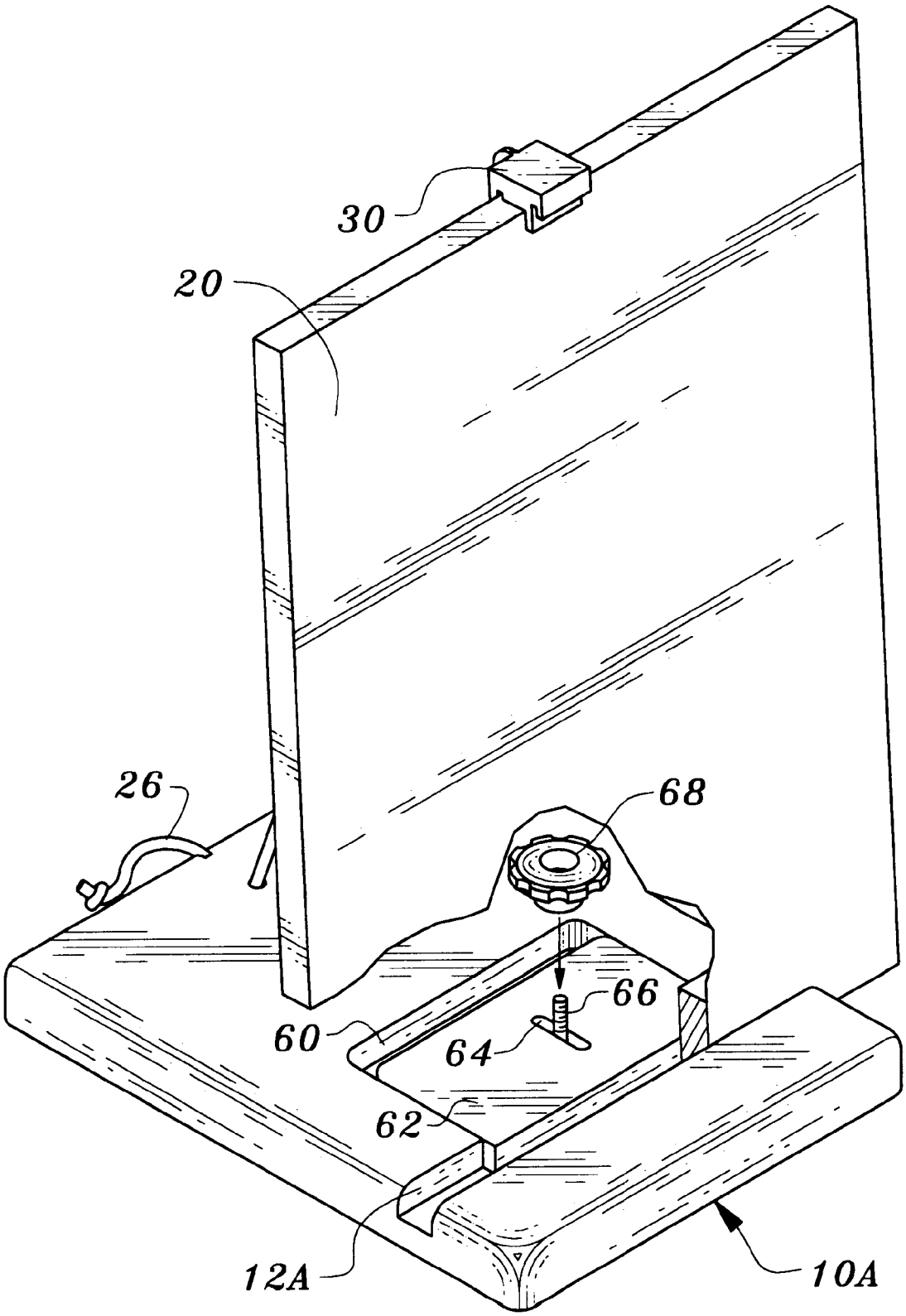
FIG. 12 is a perspective view illustrating an alternative embodiment of the invention.

FIG. 12 shows an alternate embodiment of the invention wherein easel body 10A has a recess 60 formed in the top thereof. Recess 60 slidably accommodates a plate 62 which can be moved forwardly or rearwardly relative to the easel body. The easel body side walls defining the recess are engageable by the plate side walls to guide movement of the plate.

A guide slot 64 is formed in the plate which accommodates a threaded pin or shaft 66 attached to the easel body 10A. Forward and rearward movement of the plate vary the effective width of slot 12A to accommodate frames or other members of different thicknesses. A lock cap or nut 68 threadedly engaged with member 68 is used to lock the plate at the desired position.

What is claimed is:

1. A portable easel for supporting a member having a flat painting surface, elongated top and bottom ends and sides extending between said top and bottom ends, said portable easel comprising, in combination:

an easel body having an upper surface defining a slot for receiving the bottom end of the member;

a connector for releasable connection to the top end of the member while the bottom end thereof is received in said slot; and a flexible element connected to said connector and to said easel body for exerting a bias on the member urging the member toward a tilted orientation with the lower end of the member bearing against said easel body at the location of said slot to limit movement of the member and stabilize the member relative to said easel body.

2. The portable easel according to claim 1 wherein said flexible element comprises an elastic element.

3. The portable easel according to claim 2 including means for adjusting the tension of said elastic element.

4. The portable easel according to claim 2 additionally comprising locking means for selectively lockingly engaging said elastic element at different locations along the length thereof to selectively maintain said elastic element at a desired degree of tension.

5. The portable easel according to claim 1 wherein said slot includes a first slot segment extending downwardly a first predetermined distance into said easel body and a second slot segment communicating with said first slot segment and extending downwardly a second predetermined distance into said easel body exceeding said first predetermined distance.

6. The portable easel according to claim 5 wherein said second slot segment is narrower than said first slot segment and is for accommodating a member comprising canvas board.

7. The portable easel according to claim 1 wherein said easel body defines a passageway slidably accommodating said flexible element at a location spaced from said connector whereby tension of said flexible element between said connector and said easel body may be adjusted.

8. The portable easel according to claim 7 additionally comprising locking means for selectively lockingly engaging said flexible element at different locations along the length of said flexible element to selectively maintain said flexible element at a desired degree of tension.

9. The portable easel according to claim 8 wherein said locking means comprises a recess defined by said easel body adjacent to said passageway for receiving said flexible element, said recess being narrower than said flexible element whereby said flexible element is tightly frictionally engaged by said easel body at the location of said recess to releasably lock said flexible element in place relative to said easel body.

10. The portable easel according to claim 1 wherein said member comprises a canvas stretched over a frame and wherein said slot has a width adapted to exceed the thickness of said frame.

11. The portable easel according to claim 1 wherein said connector defines at least one notch for releasably receiving the top end of said member.

12. The portable easel according to claim 11 wherein said connector defines at least two notches, at least one of said notches for receiving a member comprising a frame having a canvas stretched thereon and at least one of said notches for receiving a member comprising canvas board.

13. The portable easel according to claim 12 wherein at least some of said notches are of differing widths.

14. The portable easel according to claim 12 wherein at least two of said notches are in communication with one another.

15. The portable easel according to claim 12 wherein at least two of said notches are spaced from one another.

16. The portable easel according to claim 1 wherein said flexible element comprises an elasticized cord.

17. The portable easel according to claim 1 additionally comprising means for changing the effective width of said slot.

18. The portable easel according to claim 17 wherein said means for changing the effective width of said slot includes an adjustment member adjustably movable relative to said easel body.

19. The portable easel according to claim 18 wherein said adjustment member comprises a plate and wherein said easel body defines a recess slidably accommodating said plate.

20. The portable easel according to claim 18 additionally comprising lock means for locking said adjustment member against movement relative to said easel body.

21. A portable easel for supporting a member having a flat painting surface, elongated top and bottom ends and sides extending between said top and bottom ends, said portable easel comprising, in combination:

an easel body having an upper surface and defining a opening for receiving the bottom end of the member;

a connector for releasable connection to the top end of the member while the bottom end thereof is received in said opening; and a resilient element connected to said connector and to said easel body for exerting a bias on the member urging the member toward a tilted orientation with the lower end of the member bearing against said easel body at the location of said opening to limit movement of the member and stabilize the member relative to said easel body.

* * * * *